US006043592A

United States Patent [19]

Vaudaine

[11] Patent Number: 6,043,592

[45] Date of Patent: Mar. 28, 2000

[54] MICROTIP EMISSIVE CATHODE ELECTRON SOURCE HAVING CONDUCTIVE ELEMENTS FOR IMPROVING THE UNIFORMITY OF ELECTRON EMISSION

[75] Inventor: Pierre Vaudaine, Seyssins, France

[73] Assignee: Commissariat a l'Energie Atomique, Paris, France

[21] Appl. No.: 08/401,134

[22] Filed: Mar. 8, 1995

[30] Foreign Application Priority Data

Mar. 9, 1994 [FR] France ..... 94 02709

[51] Int. Cl.[7] ..... H01J 1/30

[52] U.S. Cl. ..... 313/309; 313/336; 313/351; 313/169.3; 313/169.4

[58] Field of Search ..... 313/308, 309, 313/336, 351, 497, 310, 169.4, 169.3

[56] References Cited

U.S. PATENT DOCUMENTS

| | | | |
|---|---|---|---|
| 4,857,161 | 8/1989 | Borel et al. | 313/309 X |
| 4,940,916 | 7/1990 | Borel et al. | 313/306 |
| 4,990,766 | 2/1991 | Simms et al. | 313/336 |
| 5,329,207 | 7/1994 | Cathey et al. | 313/309 |
| 5,536,993 | 7/1996 | Taylor et al. | 313/336 |
| 5,541,466 | 7/1996 | Taylor et al. | 313/336 |

FOREIGN PATENT DOCUMENTS

| | | |
|---|---|---|
| 0 461 990 | 12/1991 | European Pat. Off. . |
| 0 558 393 | 9/1993 | European Pat. Off. . |
| 0 572 170 | 12/1993 | European Pat. Off. . |
| 2 650 119 | 1/1991 | France . |
| WO 91/12624 | 8/1991 | WIPO . |

*Primary Examiner*—Jay Patidar
*Attorney, Agent, or Firm*—Oblon, Spivak, McClelland, Maier & Neustadt, P.C.

[57] ABSTRACT

A microtip emissive cathode electron source has a series of cathode conductors carrying a plurality of microtips and a series of grids. Each of the electrodes of at least one of the series is in contact with a resistive layer having meshes, a group of the microtips facing each mesh. A conductive element faces the interior of each mesh in front of the group of microtips corresponding to the mesh and is in contact with the resistive layer.

52 Claims, 4 Drawing Sheets

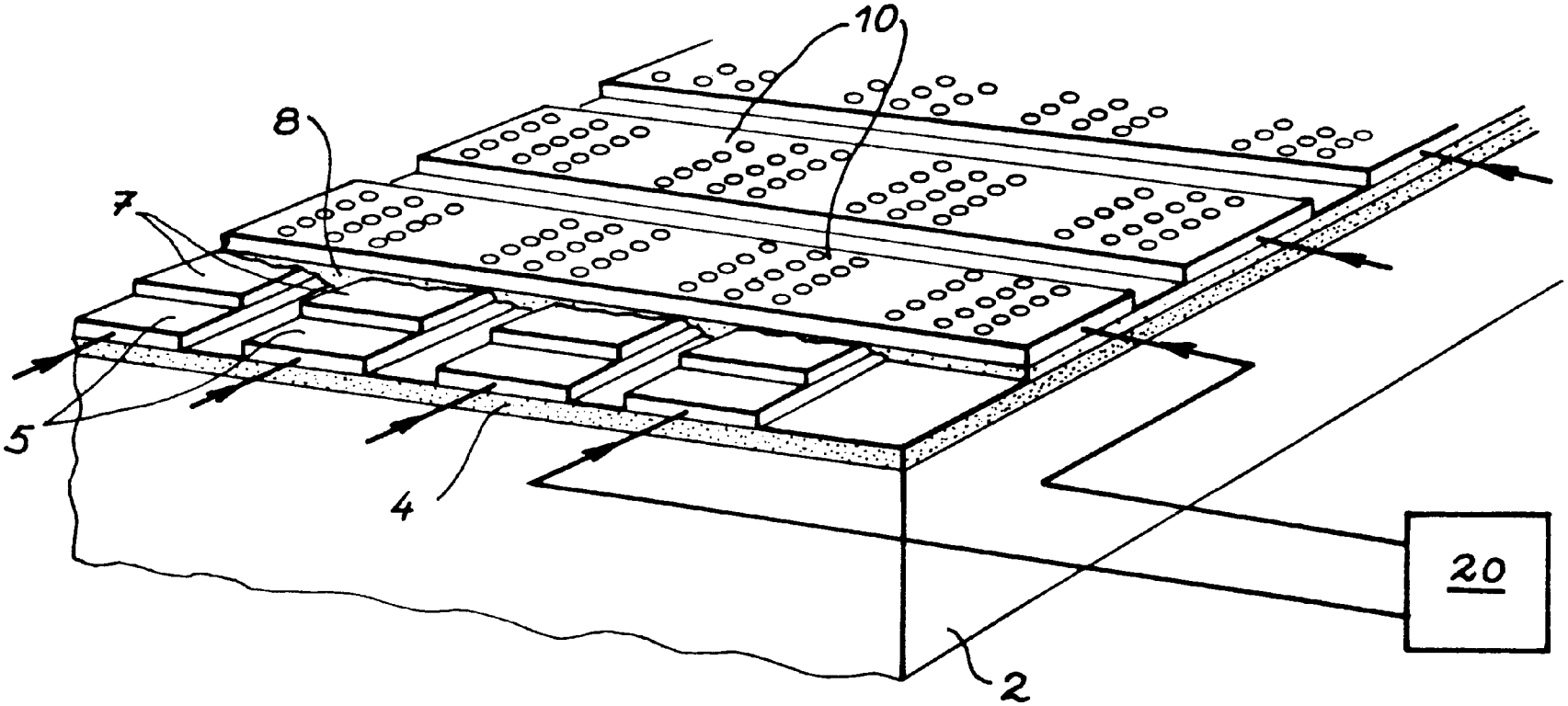
PRIOR ART FIG. 1

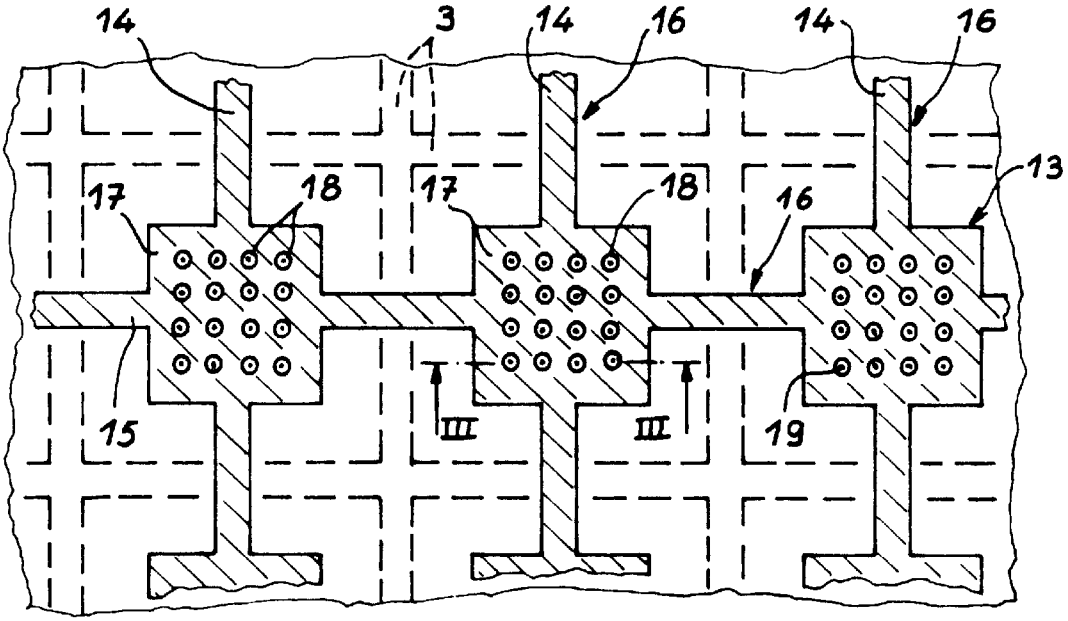
PRIOR ART FIG. 2
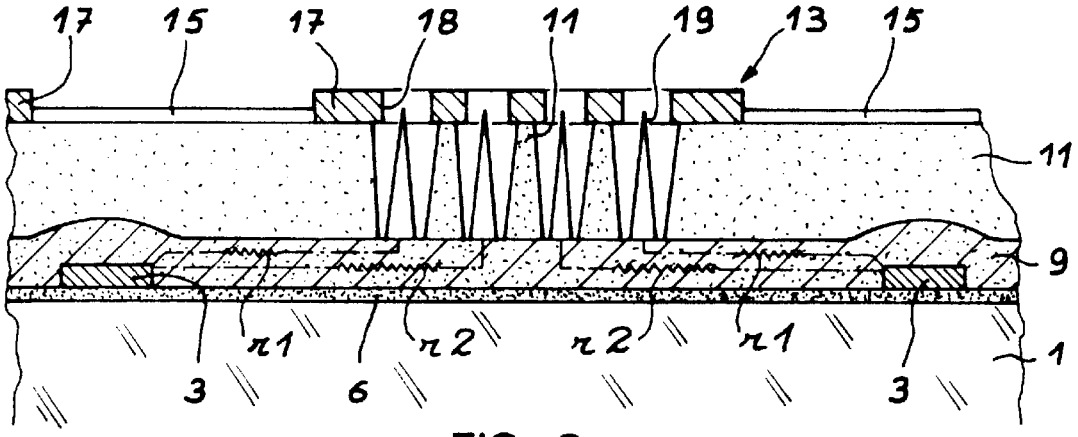
PRIOR ART FIG. 3

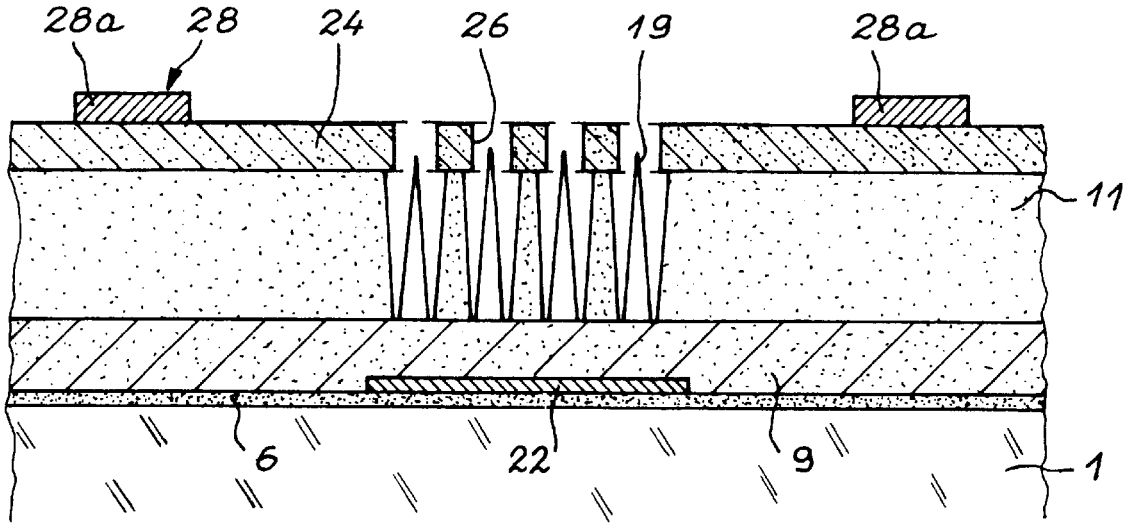
PRIOR ART FIG. 6
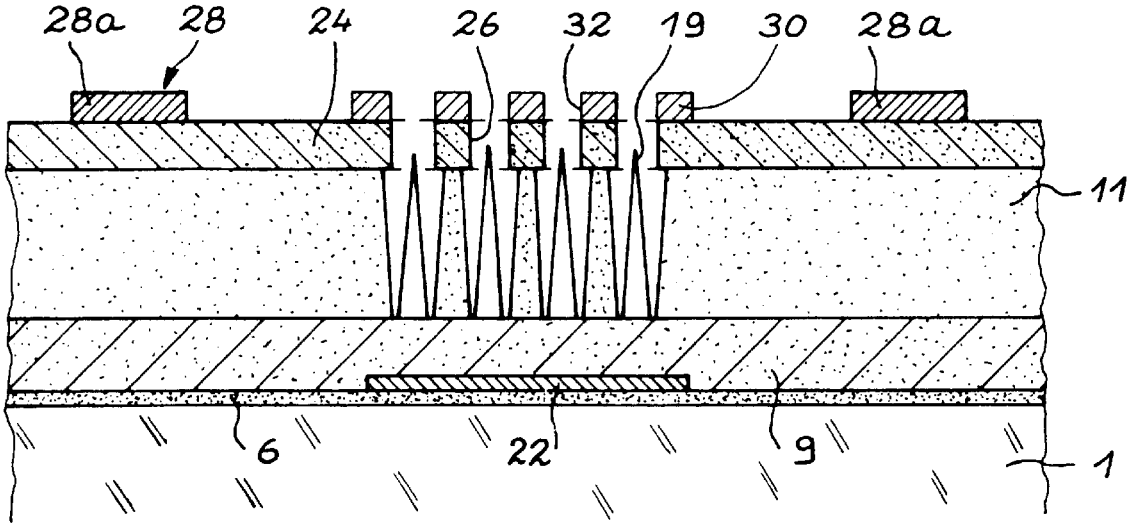
FIG. 7

MICROTIP EMISSIVE CATHODE ELECTRON SOURCE HAVING CONDUCTIVE ELEMENTS FOR IMPROVING THE UNIFORMITY OF ELECTRON EMISSION

BACKGROUND OF THE INVENTION

1. Field of the Invention

The present invention relates to an electron source with emissive cathodes having microtips. It more particularly applies to the manufacture of cathodoluminescence-based display means excited by field effect emission and in particular to the manufacture of flat screens. It is also usable for the manufacture of electron guns or vacuum gauges.

2. Discussion of the Background

Microtip emissive cathode electron sources are already known from the following documents:

(1) FR-A-2593953 corresponding to EP-A-234989 and U.S. Pat. No. 4,857,161

(2) FR-A-2623013 corresponding to EP-A-316214 and U.S. Pat. No. 4,940,916

(3) FR-A-2663462 corresponding to EP-A-461990 and U.S. Pat. No. 5,194,780

(4) FR-A-2687839 corresponding to EP-A-558393 and to U.S. patent application Ser. No. 08/022,935 filed on Feb. 26, 1993 (Leroux et al).

Document (1) describes a process for the production of a cathodoluminescence-based display means excited by field effect emission, whose microtip electron source is formed on a glass substrate and has a matrix structure.

Documents (2), (3) and (4) describe improvements made to the source described in document (1). Documents (2) to (4) more particularly relate to an improvement to the emission uniformity by limiting the current in the microtips emitting most electrons.

This improvement is obtained by introducing an electrical resistor connected in series with the microtips. This resistor is formed from a resistive layer, which can be continuous or discontinuous.

FIG. 1 is a diagrammatic, partial view of a known microtip emissive cathode electron source described in detail in document (2). This known source has a matrix structure and an e.g. glass substrate 2, on which is optionally formed a thin silica film 4.

On said silica film 4, said source also has a plurality of electrodes 5 in the form of parallel conductive strips serving as cathode conductors and which constitute the columns of the matrix structure.

Each of the cathode conductors is covered by a resistive layer 7, which can be continuous or discontinuous (except at its ends in order to permit the connection of the cathode conductors to the polarizing means 20). An electrically insulating, silica layer 8 covers the resistive layers 7.

Above the insulating layer 8 are formed a plurality of electrodes 10, once again in the form of parallel conductive strips. These electrodes 10 are generally perpendicular to the electrodes 5 and serve as gates, which form the rows of the matrix structure. A resistive layer can optionally be placed above or below the electrodes 10.

In an improvement to the source known from document (2), at least one of the series of electrodes (cathode conductors or grids) is associated with a resistive layer and each electrode of said series has a lattice or mesh structure.

Thus, document (3) recommends the use of lattice-shaped cathode conductors in such a way that the microtips are located in the openings of the lattices of the cathode conductors.

In this configuration, the breakdown resistance of a microtip is no longer mainly dependent on the thickness of the resistive layer, but instead on the distance between the microtip and the corresponding cathode conductor.

Another improvement to microtip emissive cathode electron sources is provided by document (4). This improvement aims at reducing the short-circuiting risks between the rows and columns of the source. To do this, a maximum reduction takes place of the overlap areas between the two series of electrodes.

This is diagrammatically and partially illustrated by FIGS. 2 and 3.

FIG. 2 is a diagrammatic, partial plan view of an electron source described in document (4) and FIG. 3 a larger-scale, sectional view a long the axis III—III of FIG. 2.

This known, matrix structure source has an e.g. glass substrate 1 and optionally a thin silica film 6 on said substrate 1. On the silica film 6 is formed a series of parallel electrodes 3 serving as cathode conductors, each of the said electrodes having a lattice structure. They form the columns of the matrix structure.

These cathode conductors 3 are covered by a silicon resistive layer 9, which is itself covered by an electrically insulating, silica layer 11.

Above said insulating layer 11 is formed another series of parallel electrodes also having a perforated, but different structure, which is designed to minimize the overlap areas with the cathode conductors.

These electrons formed above the insulating layer 11 are generally perpendicular to the cathode conductors and constitute the grids 13 of the source. They form the rows of the matrix structure.

FIGS. 2 and 3 show a detail of one of the grids of this source known from document (4). This grid, carrying the general reference 13, has parallel tracks 14 orthogonally intersecting other parallel tracks 15. At the intersections of the tracks 14 and 15, the grid has widened areas 17, which are square here.

FIG. 2 shows that the overlap areas 16 of a cathode conductor 3 and the tracks 14 and 15 of the grid have a very small surface. The widened areas 17 are located in the center of the meshes of the lattice-shaped cathode conductor.

In the intersection areas of the cathode conductors and the grids, holes or more precisely microholes 18 are preferably formed in the thickness of the widened areas of the grid and in the thickness of the insulating layer 11. The microtips 19 of the source are located in these holes and rest on the resistive layer.

An assembly constituted by a microtip and a microhole forms an electron microemitter. The electron microemitters occupy the central regions of the meshes of the lattice of the cathode conductor, as well as the widened, square areas 17 of the grid.

The meshes of the lattice can have different shapes and different dimensions. For example, they can be square and have a side length of 25 microns. The number of holes and tips in each mesh can also vary. Thus, there can be e.g. 4×4=16 tips per mesh.

When the source described relative to FIGS. 2 and 3 is made to operate, a voltage is applied between the cathode conductor and the grid. This leads to a current, which passes through the resistive layer between the cathode conductor and the microtips.

The further the microtips from the cathode conductor, the greater the distance separating them and the higher the electrical resistance (due to the resistive layer) by means of which said microtips are connected to the cathode conductor and therefore the lower the current supplying said microtips.

FIG. 3 shows symbolically the electrical resistance r1 of the microtips located at the edge of the group of microtips corresponding to a mesh of the cathode conductor and the electrical resistance r2 of the microtips in the center of said group of microtips, r2 being greater than r1.

It results from what has been stated hereinbefore that in the mesh, the microtips located in the centre of the group and which are further removed from the cathode conductor than the microtips located at the edge of said group, emit less electrons than the latter.

SUMMARY OF THE INVENTION

The object of the invention is to obviate this disadvantage. It aims at improving the emission uniformity of electrons by microtips located within the meshes (or more generally facing the meshes) of lattice-structure electrodes, in a microtip emissive cathode electron source.

More specifically, the present invention relates to an electron source comprising:

- a first series of parallel electrodes placed on an electrically insulating support, serve as cathode conductors and carry a plurality of electron emitting microtips,
- a second series of parallel electrodes serving as grids, which are electrically insulated from the cathode conductors and form an angle therewith, which defines intersection areas of the cathode conductors and the grids, each of the electrodes of at least one of the series being in contact with a resistive layer and having a lattice structure, incorporating tracks which intersect and define openings called meshes, a group of microtips facing each mesh, the source being characterized in that it also has an electrically conductive element facing the interior of each mesh, electrically insulated from the intersecting tracks, facing the group of microtips corresponding to said mesh and in contact with the resistive layer.

These electrically conductive elements make it possible to improve the electron emission uniformity in the source.

According to a preferred embodiment of the source according to the invention, each electrically conductive element is located within the mesh corresponding to said element. This makes it possible to simplify the manufacture of the source, because it is then possible to manufacture the conductive elements during the same stage as the lattice structure electrodes with which said elements are associated.

In order to further simplify manufacture, it is preferable for 20 the thickness of each electrically conductive element to be equal to the thickness of the electrodes having a lattice structure with which said element is associated.

According to a first embodiment of the source according to the invention, the electrodes having the lattice structure and which are associated with the electrically conductive elements ar e the electrodes of the first series of electrodes.

In this case and when each electrically conductive element is within the mesh corresponding to said element, preferably the electrodes having the lattice structure are positioned beneath the resistive layer and each electrically conductive element is also beneath said resistive layer and beneath the group of microtips corresponding to said element.

According to a second embodiment of the source according to the invention, the electrodes having the lattice structure and which are associated with the electrically conductive elements are electrodes of the second series of electrodes.

In this case and when each electrically conductive element is positioned within the mesh corresponding to said element, preferably the electrodes having the lattice structure are located on the resistive layer and each electrically conductive element is also located on said resistive layer and above the group of microtips corresponding to said element and has a hole facing each microtip of this group.

BRIEF DESCRIPTION OF THE DRAWINGS

The invention is described in greater detail hereinafter relative to non-limitative embodiments and with reference to the attached drawings, wherein show:

FIG. 1 A diagrammatic, partial view of an already described, known electron source.

FIG. 2 A diagrammatic, partial plan view of a known microtip electron source, whose cathode conductors have a lattice structure and which has already been described.

FIG. 3 A larger-scale sectional view of FIG. 2 along the axis III—III and which has already been described.

FIG. 6 A diagrammatic, partial sectional view of a known microtip electron source.

FIG. 7 A diagrammatic section view of another embodiment of the microtip electron source according to the invention.

DESCRIPTION OF THE PREFERRED EMBODIMENTS

Figure 4:
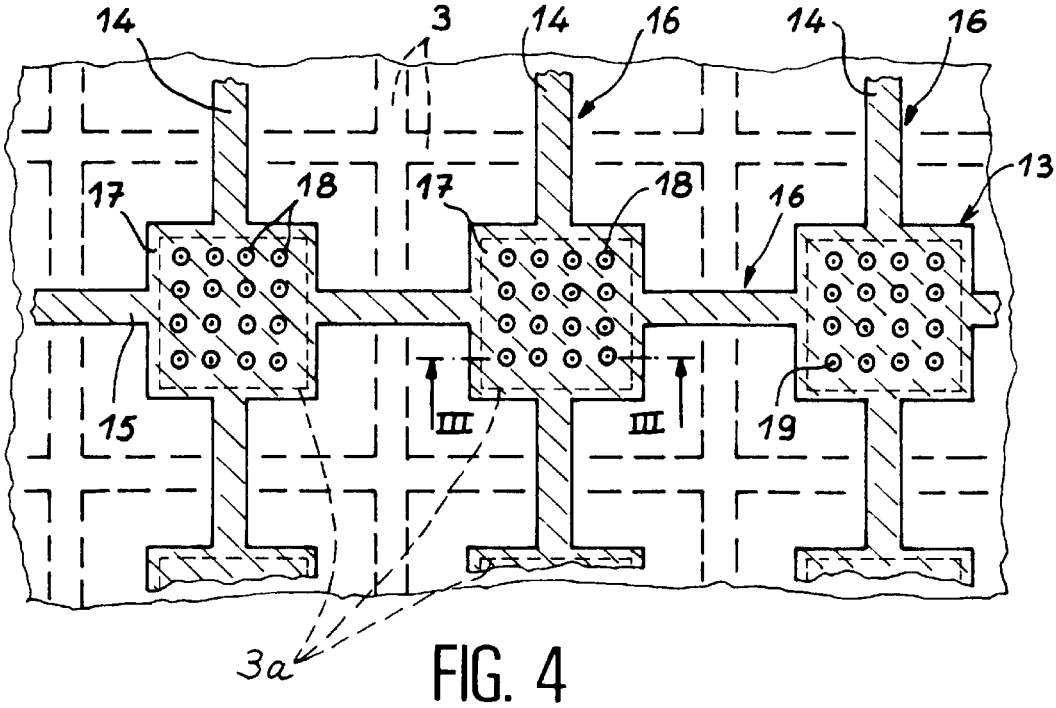
FIG. 4 A diagrammatic, partial plan view of an embodiment of the source according to the invention.
Figure 5:
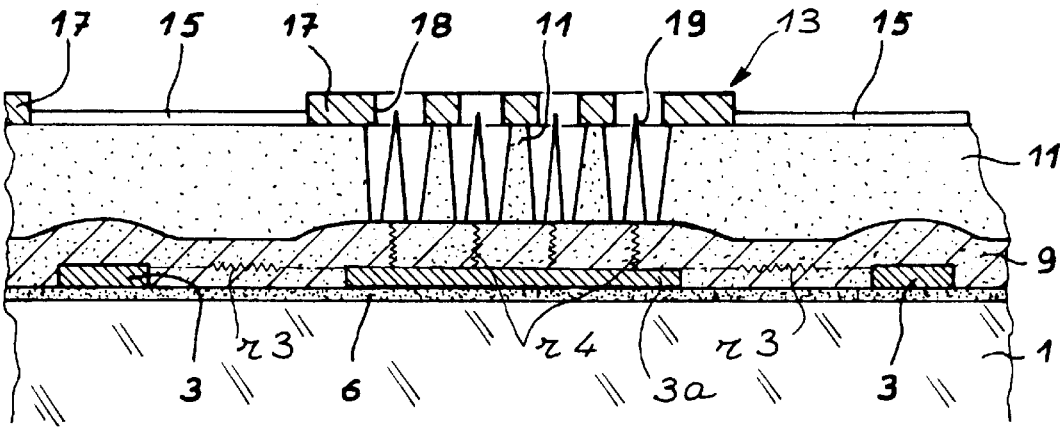
FIG. 5 A larger-scale view of FIG. 4.

The microtip source according to the invention and which is diagrammatically and partially shown in plan view in FIG. 4 and in a larger-scale section in FIG. 5 (which is along III—III of FIG. 4) is identical to the source described relative to FIGS. 2 and 3, with the exception that it also has electrically conductive elements 3*a* respectively placed within the meshes of the cathode conductors 3.

These electrically conductive elements 3*a* are intended to improve the uniformity of the emission of electrons by rendering uniform the access resistance to the microtips within each mesh.

In the embodiment shown in FIGS. 4 and 5, each electrically conductive element 3*a* constitutes an independent plate made from an electrically conductive material, which is located in the centre of each mesh, beneath the resistive layer 9, in contact with the silica layer 6 and beneath the group of microtips 19 corresponding to said mesh.

In addition, said plate 3*a* preferably occupies a surface area slightly greater than that covered by this group of microtips, as can be seen in FIGS. 4 and 5. These plates 3*a* are advantageously produced during the same photolithography stage as that during which the cathode conductors 3 are formed and using the same photomask and the same metal layer as those used for the production of the cathode conductors (so that the thickness of the plates 3*a* is the same as that of the cathode conductors).

FIG. 5 symbolically shows the electrical resistors r3 connecting each plate 3*a* to the tracks of the corresponding lattice, as well as the resistors r4 respectively between the microtips and said plates 3*a*.

The use of the plates 3*a* makes it possible to obtain the same electrical resistance r3+r4 beneath each of the microtips (r3+r4 representing the access resistance to the microtips), so that there is a better electron emission uniformity on either side of the said microtips. This access resistance to the microtips is primarily dependent on the distance between the conductive plate 3*a* and the tracks of the corresponding lattice.

For example, for square meshes of side length 25 μm and with 4×4 diameter 1.5 μm microholes, spaced from one another by 3 μm, it is possible to use square conductor plates of side length 15 μm and thickness 0.4 μm (the thickness of the cathode conductors in this example being 0.40 μm).

In practice, the dimensions of the conductor plates are adjusted as a function of the resistivity and thickness of the resistive layer 9 and also as a function of the alignment tolerance between the formation levels of the cathode conductors and the microholes.

FIGS. 4 and 5 show a grid having a perforated structure, but clearly the invention also applies to a source having respectively solid grids.

Another example of a microtip electron source is known from document (4) and is diagrammatically and partially shown in section in FIG. 6. In the known source of FIG. 6, the grids have a lattice structure, whereas the cathode conductors form unperforated structures with widened areas.

More specifically, in the example shown in FIG. 6, each cathode conductor 22 is formed on the silica layer 6 and is therefore beneath the resistive layer 9 and, in plan view, has the same shape as the electrode 13 of FIGS. 4 and 5, except that the cathode conductor has no hole level with the microtips carried by the resistive layer 9.

In the case of FIG. 6, a resistive layer 24 is formed on the insulating layer 11 and provided with holes 26 facing the microtips 19, in order to permit the passage of the electrons emitted by the said microtips 19 during the excitation of the source. The grid 28 is formed on said resistive layer 24 and has a lattice structure, whose tracks 28*a* are shown in section in FIG. 6.

In the case of FIG. 6, in place of using perforated cathode conductors, it is possible to use cathode conductors respectively forming solid strips, which are parallel to one another.

The present invention also applies to the case of FIG. 6 (with perforated or unperforated cathode conductors) in particular with a view to rendering uniform the access resistance to each microtip 19 in each mesh of the grids 28. This variant also has the advantage of rendering uniform the application time of the cathode conductor-grid voltage around each microtip 19.

Thus, FIG. 7 diagrammatically and partially illustrates in section a source according to the invention, which is identical to that of FIG. 6 except that it also has an electrically conductive element (or plate) 30 within each mesh of the grids 28 facing the group of microtips corresponding to said mesh.

More specifically, in the embodiment shown in FIG. 7, said electrically conductive element (or plate) 30 forms a square, independent plate located within said mesh, on the resistive layer 24 above the microtip group 19.

Each electrically conductive element (or plate) 30 has holes 32 aligned with the holes 26 and respectively placed facing the microtips 19 of said group. The electrically conductive element (or plate) 30 is advantageously produced during the same stage as that leading to the formation of the grids 28 and from the same conductive layer, so that the electrically conductive elements (or plates) 30 have the same thickness as the grids 28.

As in the case of document (3), the lattice structure cathode conductors of FIG. 5 need not be beneath the resistive layer 9 and could instead be located thereon (everything else being equal).

In addition, the lattice structure grids 28 of FIG. 7 need not be placed on the resistive layer 24, but could also be beneath the latter and in contact with the insulating layer 11.

In the latter case, the electrically conductive elements (or plates) 30 can either be on the resistive layer 24 in the manner shown in FIG. 7, or beneath said resistive layer 24 and in contact with the insulating layer 11 (said electrically conductive element or plates 30 then being at the same level as the grids 28 within the mesh of the latter).

Within the scope of the present invention, it is also possible to use in the same source grids and cathode conductors in the form of lattices respectively associated with conductor elements.

What is claimed as new and desired to be secured by Letters Patent of the United States is:

1. An electron source comprising:

(a) a first series of parallel electrodes forming cathode conductors which are placed on an electrically insulating support, said electrically insulating support also carrying a plurality of electron emitting microtips;

(b) a second series of parallel electrodes serving as grids, said grids being electrically insulated and spaced from the cathode conductors and forming an angle with the cathode conductors to define intersection areas, each of the electrodes of at least one of said series of parallel electrodes being in contact with a resistive layer and having a lattice structure, including tracks which intersect to define meshes, with a group of said plurality of electron emitting microtips facing each mesh; and (c) electrically conductive elements, each of said electrically conductive elements facing the interior of a corresponding mesh and being electrically insulated from said tracks and in contact with said resistive layer.

2. An electron source according to claim 1, characterized in that each electrically conductive element is located within the mesh corresponding to said element.

3. An electron source according to claim 2, wherein the thickness of each electrically conductive element is equal to the thickness of the electrodes of said first series of parallel electrodes.

4. An electron source according to claim 1, wherein:

(a) each electrically conductive element is located within the mesh corresponding to said electrically conductive element;

(b) the electrodes of said first series of parallel electrodes are positioned beneath said resistive layer; and (c) each electrically conductive element is positioned beneath said resistive layer and beneath said group of said plurality of electron emitting microtips.

5. An electron source according claim 1, wherein:

(a) each electrically conductive element is located within the mesh corresponding to said electrically conductive element;

(b) the electrodes of said second series of parallel electrodes are located on said resistive layers (c) each electrically conductive element is located on said resistive layer and above said group of said plurality of electron emitting microtips; and (d) each electrically conductive element has a hole facing each electron emitting microtip of the group.

6. An electron source according to claim 2, wherein the thickness of each electrically conductive element is equal to the thickness of the electrodes of said second series of parallel electrodes.

7. An electron emission apparatus comprising:

(a) an insulating substrate;

(b) a conductor formed as plural stripes on said insulating substrate, said plural stripes being electrically interconnected at ends thereof, (c) conductive plates on said insulating substrate, each conductive plate occupying a region laterally spaced from one of said plural stripes;

(d) a layer of an electrically resistive material overlying said conductive plates and in electrical contact with said plural stripes;

(e) an electrically insulating layer on said layer of an electrically resistive material;

(f) a conductive layer on said electrically insulating layer overlying said conductive plates, said conductive layer having a plurality of apertures formed therein and extending through said electrically insulating layer; and (g) microtip emitters on said layer of an electrically resistive material, each microtip emitter formed within a corresponding one of said apertures in said conductive layer.

8. The electron emission apparatus in accordance with claim 7 wherein said plural stripes are at least substantially parallel.

9. The electron emission apparatus in accordance with claim 7 wherein each of said conductive plates has an equal number of said microtip emitters formed over it.

10. The electron emission apparatus in accordance with claim 7 wherein said conductive plates are at least substantially equally spaced from the adjacent ones of said plural stripes.

11. The electron emission apparatus in accordance with claim 7 wherein each of said conductive plates has an at least substantially equal resistance path to the adjacent ones of said plural stripes.

12. The electron emission apparatus in accordance with claim 7 and further including means for applying a potential between said plural stripes and said conductive layer.

13. The electron emission apparatus in accordance with claim 7 wherein:

(a) said plural stripes comprise a cathode electrode and (b) said conductive layer comprises a gate electrode.

14. The electron emission apparatus in accordance with claim 7 wherein said microtip emitters are formed over each of said conductive plates as an array.

15. The electron emission apparatus in accordance with claim 7 wherein:

(a) said apertures in said conductive layer are at least generally circular and (b) said microtip emitters are at least generally cone-shaped.

16. The electron emission apparatus in accordance with claim 7 wherein said electrically resistive material comprises silicon.

17. An electron emission apparatus comprising:

(a) a conductive plate;

(b) a plurality of microtip emitters overlying said conductive plate;

(c) a conductive layer overlying said conductive plate and spaced apart from said conductive plate, said conductive layer having apertures formed therein, each of said microtip emitters formed within a corresponding one of said apertures in said conductive layer;

(d) a conductive mesh structure laterally spaced from said conductive plate; and (e) a resistive layer electrically coupled to said conductive mesh structure and to said conductive plate.

18. The electron emission apparatus in accordance with claim 17 wherein said conductive plate and said conductive mesh structure are positioned adjacent the same surface of said resistive layer.

19. The electron emission apparatus in accordance with claim 18 wherein said conductive plate is positioned within a spacing of said conductive mesh structure.

20. The electron emission apparatus in accordance with claim 17 wherein said conductive plate and said conductive mesh structure are positioned adjacent opposite surfaces of said resistive layer.

21. The electron emission apparatus in accordance with claim 17 wherein said conductive plate is positioned beneath said conductive mesh structure.

22. The electron emission apparatus in accordance with claim 17 and further including means for applying a potential between said conductive mesh structure and said conductive layer.

23. The electron emission apparatus in accordance with claim 17 wherein:

(a) said conductive mesh structure comprises a cathode electrode and (b) said conductive layer comprises a gate electrode.

24. The electron emission apparatus in accordance with claim 17 wherein said apertures are formed in said conductive layer as an array.

25. The electron emission apparatus in accordance with claim 17 wherein:

(a) said apertures in said conductive layer are at least generally circular and (b) said plurality of microtip emitters are at least generally cone-shaped.

26. The electron emission apparatus in accordance with claim 17 wherein said resistive layer comprises silicon.

27. An electron emission apparatus comprising:

(a) an insulating substrate;

(b) a conductor formed as a mesh structure on said insulating substrate, said mesh structure defining mesh spaces;

(c) a layer of an electrically resistive material on said insulating substrate overlying said mesh structure;

(d) conductive plates underlying said layer of electrically resistive material and occupying areas in said mesh spaces;

(e) an electrically insulating layer on said layer of an electrically resistive material;

(f) a conductive layer on said electrically insulating layer overlying said conductive plates, said conductive layer having a plurality of apertures formed therein and extending through said electrically insulating layer; and (g) microtip emitters on said layer of an electrically resistive material, each microtip emitter formed within a corresponding one of said apertures in said conductive layer.

28. The electron emission apparatus in accordance with claim 27 wherein each of said mesh spaces is substantially square.

29. The electron emission apparatus in accordance with claim 27 wherein each of said conductive plates includes an equal number of microtip emitters.

30. The electron emission apparatus in accordance with claim 27 wherein each of said conductive plates is at least substantially equally spaced from said conductor.

31. The electron emission apparatus in accordance with claim 27 wherein each of said conductive plates has an at least substantially equal resistance path to said conductor.

32. The electron emission apparatus in accordance with claim 27 and further including means for applying a potential between said conductor and said conductive layer.

33. The electron emission apparatus in accordance with claim 27 wherein:

(a) said conductor comprises a cathode electrode and (b) said conductive layer comprises a gate electrode.

34. The electron emission apparatus in accordance with claim 27 wherein said microtip emitters are formed on each of said conductive plates as an array.

35. The electron emission apparatus in accordance with claim 27 wherein:

(a) said apertures in said conductive layer are at least generally circular and (b) said microtip emitters are at least generally cone-shaped.

36. The electron emission apparatus in accordance with claim 27 wherein said electrically resistive material comprises silicon.

37. An electron emission apparatus comprising:

(a) an insulating substrate;

(b) a layer of an electrically resistive material on said insulating substrate;

(c) a conductor formed as a mesh structure beneath said layer of an electrically resistive material, said mesh structure defining mesh spaces;

(d) conductive plates beneath said layer of an electrically resistive material, occupying areas within said mesh spaces, and spaced from said mesh structure;

(e) an electrically insulating layer on said layer of an electrically resistive material;

(f) a conductive layer on said electrically insulating layer overlying said conductive plates, said conductive layer having a plurality of apertures formed therein and extending through said electrically insulating layer; and (g) microtip emitters on said layer of an electrically resistive material, each microtip emitter formed within a corresponding one of said apertures in said conductive layer.

38. The electron emission apparatus in accordance with claim 37 wherein each of said mesh spaces is substantially square.

39. The electron emission apparatus in accordance with claim 38 wherein each of said conductive plates includes an equal number of microtip emitters.

40. The electron emission apparatus in accordance with claim 37 wherein each of said conductive plates is at least substantially equally spaced from said conductor.

41. The electron emission apparatus in accordance with claim 37 wherein each of said conductive plates has an at least substantially equal resistance path to said conductor.

42. The electron emission apparatus in accordance with claim 37 and further including means for applying a potential between said conductor and said conductive layer.

43. The electron emission apparatus in accordance with claim 37 wherein:

(a) said conductor comprises a cathode electrode and (b) said conductive layer comprises a gate electrode.

44. The electron emission apparatus in accordance with claim 37 wherein said microtip emitters are formed on each of said conductive plates as an array.

45. The electron emission apparatus in accordance with claim 37 wherein:

(a) said apertures in said conductive layer are at least generally circular and (b) said microtip emitters are at least generally cone-shaped.

46. The electron emission apparatus in accordance with claim 37 wherein said electrically resistive material comprises silicon.

47. An electron emission apparatus comprising:

(a) a conductive mesh structure defining a mesh spacing;

(b) a conductive plate laterally spaced from said conductive mesh structure and occupying a central region within said mesh spacing;

(c) a resistive layer in electrical contact with said conductive mesh structure and said conductive plate; and (d) a plurality of microtip electron emitters located in said central region.

48. The electron emission apparatus in accordance with claim 47 wherein:

(a) said electron emission apparatus further comprises a conductive layer electrically isolated from said conductive mesh structure, said conductive plate, and said resistive layer;

(b) said conductive layer has apertures formed therein; and (c) each of said plurality of microtip electron emitters is formed within a corresponding one of said apertures in said conductive layer.

49. The electron emission apparatus in accordance with claim 48 and further including means for applying a potential between said conductive mesh structure and said conductive layer.

50. The electron emission apparatus in accordance with claim 48 wherein:

(a) said conductive mesh structure comprises a cathode electrode and (b) said conductive layer comprises a gate electrode.

51. The electron emission apparatus in accordance with claim 48 wherein said apertures are formed in said conductive layer as an array.

52. The electron emission apparatus in accordance with claim 48 wherein:

(a) said apertures in said conductive layer are at least generally circular and (b) said plurality of microtip electron emitters are at least generally cone-shaped.

* * * * *